United States Patent [19]

Holmqvist et al.

[11] Patent Number: 4,467,843

[45] Date of Patent: Aug. 28, 1984

[54] METHOD OF OPERATING A METERING APPARATUS FOR LIQUID

[75] Inventors: Richard Holmqvist, Bromma; Erling Berglund, Järfälla; Göran Högberg, Bromma, all of Sweden

[73] Assignee: Clinicon AB, Bromma, Sweden

[21] Appl. No.: 316,399

[22] Filed: Oct. 29, 1981

[30] Foreign Application Priority Data

Nov. 18, 1980 [SE] Sweden ..... 8008086

[51] Int. Cl.[3] ..... B65B 3/04

[52] U.S. Cl. ..... 141/1; 141/91; 141/116

[58] Field of Search ..... 141/89–92, 141/115, 116, 117, 1–12, 85–88

[56] References Cited

U.S. PATENT DOCUMENTS

| | | | |
|---|---|---|---|
| 2,103,817 | 12/1937 | Johnson | 141/116 |
| 2,107,987 | 2/1938 | Johnson | 141/116 |
| 3,484,024 | 12/1969 | Jones et al. | 141/117 |

*Primary Examiner*—Houston S. Bell, Jr.
*Attorney, Agent, or Firm*—Browdy and Neimark

[57] ABSTRACT

A metering apparatus including a metering pump having a vertical, elongate pump cylinder tapered at one end to a point, and a piston arranged for axial movement in said cylinder, facilitates transfer of an accurately determined volume of liquid from a first vessel to a second vessel. A method of transfer involves lowering the pump into the first vessel; with the point extending into the liquid contained therein; withdrawing the piston through a first distance such that a volume of liquid substantially exceeding the volume to be transferred is drawn into the pump cylinder; raising the pump slowly, until the pointed part of the pump cylinder occupies a position above the surface of the liquid; advancing the piston through a distance which corresponds exactly to the first and second distances so that the desired amount of liquid is dispensed to the second vessel. Immediately after dispensing the required amount of liquid to the second vessel, the piston is again withdrawn through a short distance, to prevent a liquid droplet from forming on the point of the pump cylinder.

The method of transfer also contemplates a procedure for washing the pump prior to transferring a second sample, which comprises completely emptying the pump into a waste outlet, drawing washing liquid into the pump, and expelling the washing liquid from the pump.

2 Claims, 4 Drawing Figures

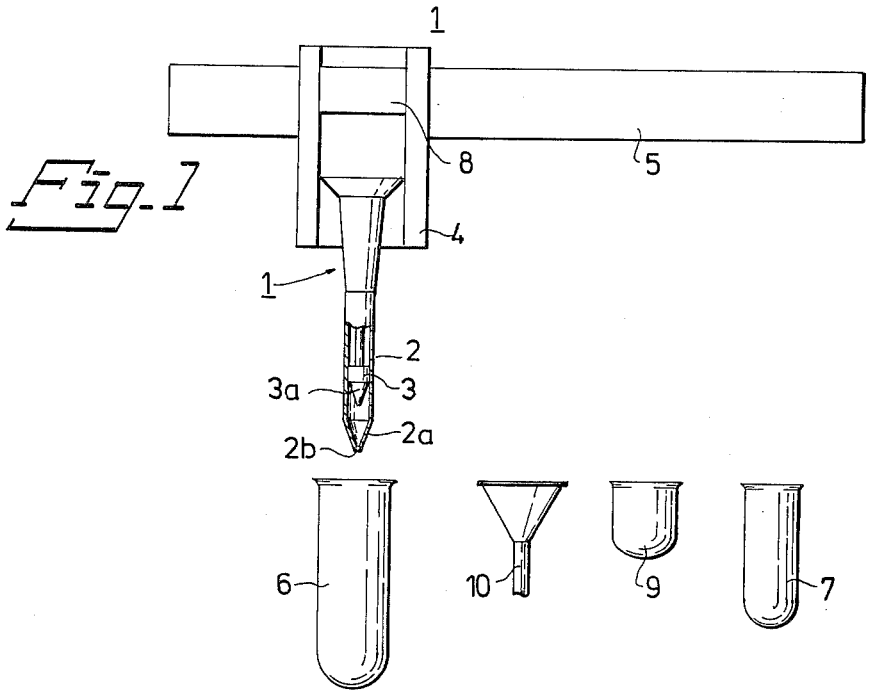
Fig. 1
Fig. 2
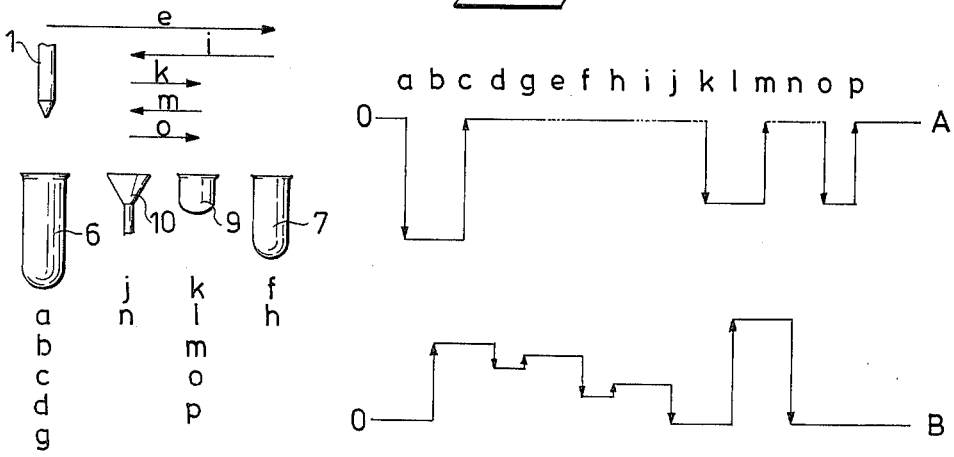
Fig. 3A
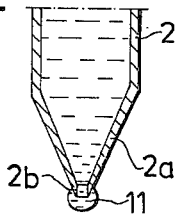
Fig. 3B
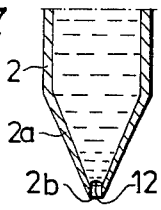

METHOD OF OPERATING A METERING APPARATUS FOR LIQUID

BACKGROUND OF THE INVENTION

The present invention relates to a method of operating a metering or dispensing apparatus for transferring accurately determined volumes of liquid from vessels containing said liquids to other vessels, for example to reactor tubes forming part of an automatic clinical analysis apparatus. The metering apparatus to which the invention refers is of the kind which comprises a metering pump having a pump cylinder which tapers to a point at one end and in which a filling orifice is located at the pointed end of said cylinder. A piston is arranged for axial movement in the pump cylinder and seals against the internal wall surface thereof. The piston has a maximum terminal position of forward displacement at said cylinder end, and when occupying this forward terminal position, the cylinder volume communicating with the filling orifice in said pointed end of the cylinder is O. The apparatus is provided with means for accurately controlling the axial movement of the piston in the cylinder, so that the cylinder volume communicating with said filling orifice can be suitably varied. The apparatus is also provided with means for moving the pump horizontally and vertically. An advantageous embodiment of a metering apparatus of the aforedescribed kind is described, for example, in the European Pat. No. 009013 issued June 2, 1982 (corresponding to U.S. Pat. No. 4298575 issued Nov. 3, 1981). This known metering apparatus is a high precision apparatus in which, for example, the piston can be moved through extremely accurately determined distances within the pump cylinder, and in which when the piston is moved to its maximum forward terminal position in the cylinder, the pointed end of the cylinder is completely filled by the piston, such that no residual volume remains within said cylinder. Despite the attributes of this known apparatus, however, considerable difficulty is experienced in obtaining the desired high degree of accuracy with respect to the volumes of liquid transferred by said apparatus, and primarily in preventing the carry-over of one liquid to another liquid when the metering apparatus is used for transferring given volumes of several different liquids sequentially, and the carry-over of washing liquid, normally distilled water, which is used for washing the interior of the pump cylinder between the transfer of two mutually different liquids. It will be understood that such carry-over must be avoided, since it results in contamination and dilution of the liquids transferred. These problems are related to the fact that even with the most accurate of metering apparatus of the kind described it is difficult to completely eliminate resilience and play in the system which drives the piston in the pump cylinder. Further, in order to be able to dispense accurately determined volumes of liquid, it is necessary to obtain a well defined and stable jet of liquid from the pointed end of the cylinder throughout the whole of a dispensing operation, said jet being initiated and interrupted practically instantaneously. If the liquid jet is not well defined and stable, the jet is liable to break up and cause splashing at the beginning and the end of a dispensing operation. Further, liquid is liable to wet the outer surface of the pointed end of the pump cylinder or form a droplet on said end.

SUMMARY OF THE INVENTION

It is therefore an object of the present invention to solve the above-described disadvantages inherent in the conventional liquid-metering apparatus, and to provide a method for operating a metering apparatus of the kind described in which the carry-over of one liquid to another liquid is at least substantially avoided.

A further object of the invention is to provide a method for operating a liquid metering apparatus in a manner to obtain a well defined and stable liquid jet.

To this end it is proposed that in a liquid metering apparatus of the kind described the metering pump is moved to a position above said first vessel and then lowered so that the pointed part of the cylinder extends into the liquid contained in the vessel; that the piston is withdrawn in the cylinder to an extent which substantially exceeds the piston position corresponding to the given volume of liquid to be transferred; that the metering pump is raised to withdraw the pointed part of the cylinder to a position above the surface of the liquid in the vessel; that the piston is moved forwards in the cylinder so that part of the liquid withdrawn is returned to said first vessel; that the metering pump is moved to a position above said second vessel; and that the piston is moved forwards through a distance corresponding precisely to the given volume of liquid to be transferred.

So that the invention will be more readily understood and further features thereof made apparent, an exemplary embodiment of the invention will now be described with reference to the accompanying drawing.

BRIEF DESCRIPTION OF THE DRAWING

In the drawing:

FIG. 1 illustrates schematically a metering apparatus with which the invention can be applied;

FIG. 2 is a diagram illustrating schematically the various operational steps when operating a metering apparatus in accordance with the invention; and FIGS. 3A and 3B are axial sectional views in larger scale through the pointed part of the pump cylinder of a metering apparatus, illustrating the position of the liquid at said pointed part in different stages of a liquid metering operation.

A DETAILED DESCRIPTION OF THE INVENTION

FIG. 1 illustrates schematically an exemplary embodiment of a liquid metering apparatus with which the method according to the invention can be applied. The metering apparatus comprises a metering pump, generally shown at 1, which includes a vertically extending, elongate tubular pump cylinder 2 and a piston 3 arranged for axial movement in said cylinder. The cylinder 2 tapers conically at one end thereof to form a pointed part 2*a*, which is provided with a fine central opening 2*b*. The piston 3 has a corresponding conical pointed part 3*a*, so that when occupying its maximum forward terminal position of displacement, the piston completely fills the pointed part 2*a* of the cylinder 2 without any space remaining between the mutually opposing surfaces of the piston and the cylinder. The apparatus also includes a drive unit 8 for controlable and accurate displacement of the piston 3. The whole of the metering pump is carried by a carriage 4 and can be raised and lowered on the carriage by means of suitable devices herefor (not shown). The carriage 4 is carried by a suitable means (not shown) and is arranged to be moved by said means along a path 5. An example of a metering apparatus of this kind is described in the aforementioned European patent application.

Such a metering apparatus can be used for transferring accurately determined volumes of liquid from a first vessel 6, for example a test tube containing a liquid sample, to a second vessel 7, for example a reaction tube in an automatically operating, clinical analysis apparatus. In the transfer of said given volumes of liquid between said vessels, the pump 1 is moved by the carriage 4 to the position illustrated in FIG. 1, directly above the test tube 6 and lowered down thereinto, so that the pointed part of the cylinder 2 projects into the liquid. The piston 3 is then withdrawn in the cylinder 2, so as to draw a given quantity of liquid into the cylinder, whereafter the pump 1 is lifted from the test tube 6. The pump 1 is then moved by the carriage 4 to a position directly above the reaction tube 7, and the piston 3 is advanced in the cylinder 2 through a distance corresponding to the volume of liquid to be dispensed to the reaction tube 7. If the metering apparatus is to be used to transfer sequentially a plurality of mutually different samples from mutually different test tubes to mutually different reaction tubes 7, or optionally to one and the same reaction tube 7, it is necessary to wash the pump 1 between the different sample-transfer operations. To this end, there is provided a cup-like body 9 which is constantly held filled with a suitable washing liquid, normally distilled water, and a schematically illustrated waste outlet 10. In washing the metering pump 1, the pump is moved by means of the carriage 4 to a position immediately above the outlet 10, subsequent to said pump delivering said given volume of sample to the reaction tube 7. The piston 3 is then moved to its maximum forward terminal position in the cylinder 7 so that all residual liquid in the pump is ejected into the outlet 10. The pump 1 is then moved to a position immediately above the cup-like body 9 and lowered thereinto, whereafter the piston 3 is withdrawn in the cylinder, to draw water into the pump. The pump is then lifted from the body 9 and moved back to the waste outlet 10, where the pump is emptied of washing liquid, whereafter the transfer of a fresh sample can commence.

It wll be understood that in a metering arrangement of the afore-described, special kind there may be provided a plurality of different test tubes 6 for different liquid samples, and also a plurality of different reaction tubes 7 for receiving metered volumes of the different samples. It will also be understood that the mutual positioning of the test tubes 6, the reaction tube 7, the cup-like body 9 for washing liquid and the waste outlet 10 may be different to that illustrated in FIG. 1, and also that the means for raising and lowering the metering pump 1 and for moving said pump laterally may have any suitable form.

According to the invention, a metering operation of the aforedescribed kind is carried out in a particular manner, as illustrated schematically in FIG. 2. FIG. 2 illustrates schematically the metering pump 1, a test tube 6, a reaction tube 7, a cup-like body 9 for cleaning liquid and the waste outlet 10. FIG. 2 also shows two curves A and B. The curve A illustrates vertical movement of the metering pump 1, i.e. the raising and lowering of the pump in the various operational stages during a complete metering operation and subsequent washing operation(s), while the curve B illustrates correspondingly movement of the piston 3 in the pump cylinder 2 in the various operational stages. The starting level O of the curve A marks the fully raised position of the metering pump 1, in which position said pump can be moved laterally. The broken parts of the curve A indicate that the metering pump 1 is moved laterally in the manner shown by arrows to the left of FIG. 2 during corresponding operational stages. The starting level O for the curve B indicates the maximum terminal position of displacement for the piston 3 in the pump cylinder 2. It should be noted that the horizontal distances between the various operational stages a–p in curves A and B are not in any way intended to correspond to or be proportional to the time intervals between the operational stages in question. Thus, the time intervals between the various sequential operational stages may be of greatly differing lengths, and the curves A and B merely illustrate the mutual order sequence in which the various operational stages takes place. Beneath the schematic symbols representing the test tube 6, the reaction tube 7, the cup-like body 9 and the waste outlet 10 are given the respective references a to p, showing in which of the operational stages a–p the pump 1 is located above a respective element 6, 7, 9 and 10.

A metering operation is started by positioning the pump 1 immediately above the test tube 6 and, in operational stage a, lowering the pump into the test tube, so that the pointed part of the cylinder 2 extends into the sample liquid contained in the tube 6. In this stage, the piston 3 occupies its maximum terminal position of forward displacement in the pump cylinder 2.

In the next operational stage b, the piston 3 is withdrawn in the cylinder 2 to an extent such that a volume of sample liquid is drawn into the cylinder 2, said volume exceeding substantially the predetermined volume of liquid to be transferred to the reaction tube 7.

In the next following operational stage c, the metering pump 1 is raised from the test tube 6. In order to avoid a film of sample liquid accompanying the cylinder 2 on the outer surfaces thereof, the metering pump is, to advantage, first raised slowly, until the pointed part of the cylinder 2 leaves the sample liquid, and then at a greater speed.

In the next operational stage d, the piston 3 is advanced through a given distance in the cylinder 2, so that part of the surplus volume of sample liquid is returned to the tube 6. This eliminates the effect of play and resilience in the piston drive system.

It has been found that at the end of operational stage d, a liquid droplet 11 remains outside of the opening **2*b* in the pointed part 2*a* of the cylinder 2, as illustrated in FIG. 3A. In many aspects this is a disadvantage. For example, this liquid droplet may fall from the pointed part 2*a* of the cylinder, so that the corresponding liquid volume is not delivered in the subsequent dispersement of a precise volume of liquid to the reaction tube 7. Further, the droplet 11 may spread to form a film on the outer surface of the conical pointed part 2*a* of the cylinder, with the same result. Even though none of these events takes place, it is a disadvantage to begin dispersion of the liquid to the tube 7 from the state illustrated in FIG. 3A. It will be understood that a well defined and stable jet of liquid from the opening 2*b* in cylinder 2 is not obtained right from the beginning of a sample dispensing operation to the tube 7, when the piston 3 begins to move forwards in the cylinder 2, because a certain amount of time is required for the liquid in the cylinder 2 to accelerate to the requisite velocity. During this acceleration period, the liquid droplet 11 and the outermost liquid present in the opening 2*b*** will leave the cylinder 2 in an undefined manner. In order to avoid these disadvantages, the piston 3 is suitably withdrawn through a short distance in the cylinder 2 when carrying out the next operational stage g, so that the droplet 11 is drawn into the cylinder 2 and so as to form a liquid miniscus 12 some distance within the pointed part of the pump cylinder, as illustrated in FIG. 3B. Timewise, the operational stage g is suitably carried out immediately after operational stage d. In this way there is obtained a well defined starting position for dispensing an accurately determined volume of liquid to the tube 7.

In the next-following operational stage e, the metering pump 1 is thus moved sideways, to a position immediately above the tube 7.

In the next operational stage f, liquid in the pump 1 is dispensed to the tube 7, by moving the piston 3 forwards in the cylinder 2 through a distance which corresponds exactly to the volume of liquid to be dispensed, plus that distance through which the piston was withdrawn in the cylinder 2 in the operational stage g. By beginning the dispensing operation from the state illustrated in FIG. 3B, the liquid has time to accelerate before reaching the mouth of the opening 2*b* in the cylinder 2, whereby the liquid is dispensed in a stable, well defined jet right from the beginning of the dispensing operation.

Immediately after dispensing movement of the piston 3 in operational stage f, the piston 3 is withdrawn in the cylinder 2 in the next operational stage h through a distance which is equal to the extent to which the piston is withdrawn in the operational stage g. In this way the liquid jet is interrupted abruptly when the required volume of liquid has been dispensed to the tube 7, and no liquid droplet remains on the point of cylinder 2 at the end of the dispensing operation. Thus, at the end of the dispensing operation exactly the same state exists, i.e. the state illustrated in FIG. 3B, as at the beginning of the dispensing operation. This ensures a high degree of accuracy with respect to the volume of liquid dispensed.

Subsequent to transferring an accurately determined volume of liquid from the testg tube 6 to the reaction tube 7 in the manner aforedescribed, the metering pump must be washed before a further sample transfer operation is carried out.

Washing is effected by moving the metering pump 1 in the next-following operational stage i from the reaction tube 7 to a position above the waste outlet 10, in which position the piston 3 is advanced in the next-following operational step j, up to its maximum terminal position in the cylinder 2, so that any sample liquid remaining in the pump is delivered to the outlet 10. It should be noted that the amount of sample liquid drawn into the metering pump 2 in operational stage b is so large that a certain amount of liquid remains in the pump subsequent to the dispensing operation in operational stage f.

In the next operational stage k, the metering pump 1 is then moved to a position above the cup-like body 9 and lowered down thereinto, so that the pointed part of the cylinder 2 extends into the water.

In the next-following operational stage 1, the piston 3 is withdrawn in the cylinder 2 through a distance which at least corresponds to, and preferably exceeds the distance through which the piston was withdrawn in the operational stage b. In this way, washing liquid is drawn into the cylinder 2 in an amount which exceeds the maximum amount of sample liquid previously held in the pump cylinder.

In the next operational stage m, the metering pump 1 is lifted out of the cup-shaped body 9 and moved back to a position above the waste outlet 10. With the pump located in this position, the piston 3 is in the following operational stage n again advanced to its maximum terminal position in the cylinder 2, thereby emptying the cylinder 2 of washing liquid. As before described, a droplet forms on the pointed part 2*a* of the cylinder during this operation. This droplet must be removed, since otherwise the next sample to be transferred by the pump will be diluted to some extent. It will be understood that, in this case, it is not possible to remove the droplet by withdrawing the piston 3 in the cylinder 2, since this would only cause the droplet to be drawn into the pointed part of said cylinder.

In order to remove the droplet, the metering pump 1 is moved in the next operational stage o back to a position immediately above the cup-like body 9 and lowered down thereinto, so that the pointed part 2*a* of the cylinder extends into the washing liquid, i.e. the water. The metering pump is then again lifted in the next-following operational stage p, to draw the cylinder 2 out of the water. By slowly lifting the pump until the pointed part of the cylinder 2 leaves the water, it is possible to avoid a droplet on the pointed part of said cylinder 2 as said pointed part leaves the surface of the water. Once the pointed part of the cylinder 2 has left the surface of the water, the pump 1 can be raised to the starting position O more quickly.

This completes the pump washing operation, and a new sample transfer can be made, by repeating the aforedescribed operational stages with respect to another test tube 6 and another reaction tube 7.

It will readily be understood that the method according to the invention can be applied in many different contexts where a metering apparatus of the described kind for transferring accurately metered quantities of different liquids in sequence. The liquids to be transferred need not, of course, be sample liquids, but may instead be, for example, different liquid reagents which are to be transferred to different reaction tubes in an automatically operating clinical analysis apparatus.

We claim:

1. A method of operating a metering apparatus for transferring accurately determined volumes of liquids successively from a number of first vessels containing said liquids to respective ones of a number of second vessels, said apparatus comprising:

a metering pump including a pump cylinder which tapers to a point at one end thereof and which has an opening arranged in said pointed end, a piston arranged for axial movement within said cylinder while sealing against the internal surface of the cylinder and having a maximum terminal position of forward displacement at said end of said cylinder, in which forward terminal position of the piston the cylinder volume communicating with said opening in said pointed end of the pump cylinder is zero, means for accurately controlling the axial movement of the piston in the cylinder, to enable the cylinder volume communicating with said opening to be varied, means for moving the metering pump horizontally, and means for moving said pump vertically;

said method comprising the operational steps of (a) moving the metering pump to a position above one of said first vessels, and lowering the pump so that said pointed end of the pump cylinder extends into the liquid of said first vessel;

(b) withdrawing the piston in the cylinder through a distance which exceeds substantially the distance corresponding to the volume of liquid to be transferred from said first vessel;

(c) raising the metering pump so as to remove the pointed end of the pump cylinder to a position above the surface of the liquid in said first vessel;

(d) advancing the piston in the pump cylinder so that part of the amount of liquid drawn into the pump cylinder in step (b) is returned to said first vessel;

(e) immediately withdrawing the piston through a short distance in the pump cylinder, so that any droplets which may remain on the pointed end of the pump cylinder subsequent to step (d) is or are withdrawn into the pump cylinder;

(f) moving the metering pump to a position above one of said second vessels;

(g) advancing the piston in the pump cylinder through a distance equal to the sum of a distance corresponding to said given volume of liquid to be transferred and the distance through which the piston was withdrawn in step (e);

(h) immediately withdrawing the piston in the pump cylinder through a short distance, so that any liquid droplets remaining on the pointed end of the pump cylinder subsequent to step (g) are drawn into the pump cylinder;

(i) moving the metering pump to a position above a waste outlet;

(j) advancing the piston to its maximum forward terminal position, so as to empty the pump cylinder of liquid present therein;

(k) moving the metering pump to a position above a vessel containing a washing liquid and lowering the pump until the pointed end of the pump cylinder extends into said washing liquid;

(l) withdrawing the piston in the pump cylinder through a distance which at least corresponds to the maximal withdrawal of the piston during any of the preceding operational steps;

(m) raising the metering pump from the washing liquid and moving it to a position above said waste outlet;

(n) advancing the piston to its maximum forward terminal position, so as to empty the pump cylinder of washing liquid;

(c) moving the metering pump again to a position above said vessel containing said washing liquid and lowering it so that the pointed end of the pump cylinder extends into the washing liquid.

(p) again raising the metering pump slowly, so that the pointed end of the pump cylinder is drawn out of the washing liquid without entraining a liquid droplet therewith; and thereafter repeating steps (a)–(h) with respect to liquid to be transferred from another one of said first vessel to a respective other one of said second vessels.

2. A method as claimed in claim 1, in which in operational step (c) the metering pump is first raised slowly until the pointed end of the pump cylinder has left the surface of the liquid in said first vessel, and then raised at a higher speed.

* * * * *